United States Patent [19]

Denker

[11] Patent Number: 5,005,470

[45] Date of Patent: Apr. 9, 1991

[54] PORTABLE WORK STATION

[76] Inventor: James G. Denker, 9802 E. 33rd St., Tucson, Ariz. 85748

[21] Appl. No.: 434,779

[22] Filed: Nov. 9, 1989

[51] Int. Cl.[5] ..... F24F 7/013

[52] U.S. Cl. ..... 98/115.3; 15/301; 15/327.2; 55/374; 55/467

[58] Field of Search ..... 98/115.3; 55/374, 467; 15/301, 327.2

[56] References Cited

U.S. PATENT DOCUMENTS

| | | | |
|---|---|---|---|
| 2,291,546 | 7/1942 | George | 15/301 X |
| 2,582,092 | 1/1952 | Ancet | 15/301 X |
| 3,797,205 | 3/1974 | Weisskopf | 55/467 X |
| 4,163,650 | 8/1979 | Watson et al. | 55/467 X |
| 4,197,646 | 4/1980 | Morrison | 98/115.3 X |
| 4,276,819 | 7/1981 | Goldman et al. | 98/115.3 |
| 4,852,468 | 8/1989 | Harris | 98/115.3 |
| 4,932,098 | 6/1990 | Haines | 15/301 |

*Primary Examiner*—William E. Tapolcai

*Attorney, Agent, or Firm*—Burns, Doane, Swecker & Mathis

[57] ABSTRACT

A carrying case with upper and lower case sections connected by means of hinges opens to a point where the upper case section is held upright including a conopy projects upward and outward from the two case sections of the case when opened wherein an opening in the front of the canopy permits access to the chamber created within the canopy and the case sections including fixtures suited to handling and repairing mechanical components are attached to the interior surfaces of the case and an exhaust fan in mounted in series with a filter chamber to draw ambient air through the front opening, to continuously evacuate the contents of the chamber, and to exhaust the filtered air through the upper case section and further including a vacuum device in series with a filter is equipped with a hose for cleaning objects inside or outside the chamber and for exhausting the air through an opening in the upper case section.

25 Claims, 2 Drawing Sheets

FIG. 1
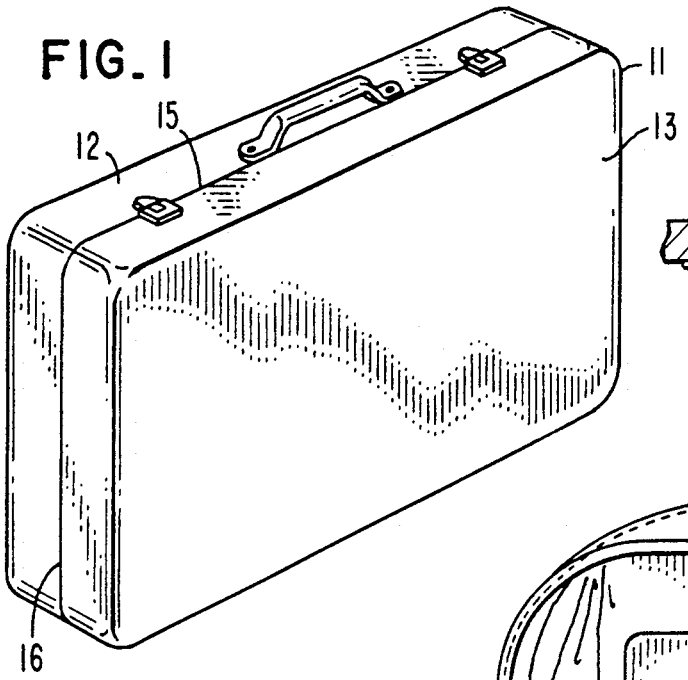
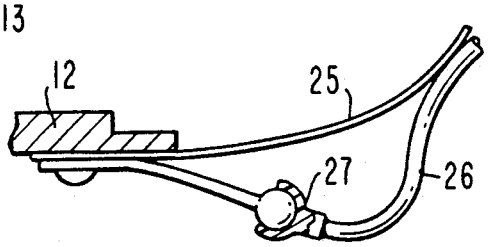
FIG. 7
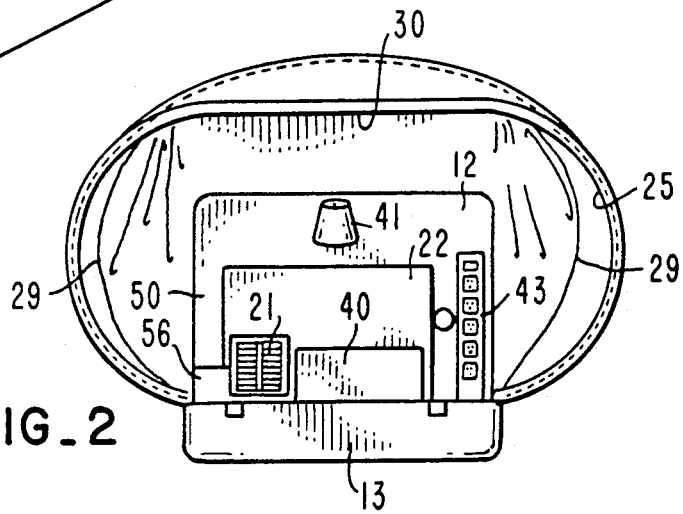
FIG. 2
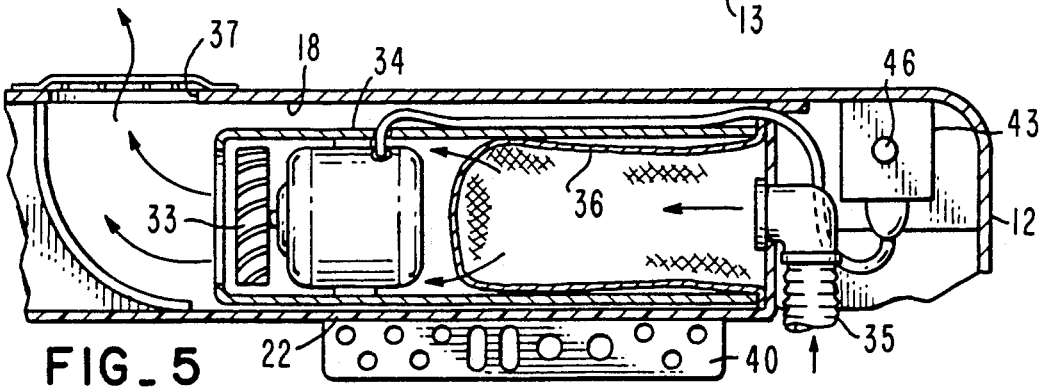
FIG. 5
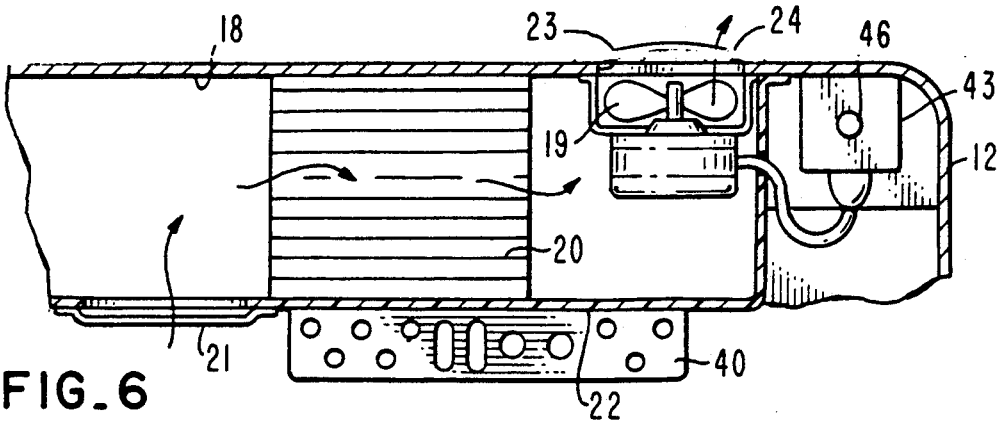
FIG. 6

PORTABLE WORK STATION

BACKGROUND OF THE INVENTION

1. Field of the Invention

This invention deals with a portable environment suited to repairing equipment which releases airborne particulate contamination.

2. Description of Related Art

Servicing and repairing photocopier components such as developer stations, cleaning units, or toner cartridges typically releases airborne contaminated particulates. Toner particles are readily attracted to areas bearing an electrostatic charge. The minuscule toner particles permanently discolor furnishings and foul the operations of electromechanical equipment.

Due to the dirty and potentially dangerous nature of servicing toner handling components, toner cartridges are generally either discarded or are transported to an industrial facility for servicing under conditions of specialized lighting and exhaust gas control. Operating a photocopier or printer is far less expensive when an expedient method for servicing toner handling components is available without utilizing a permanent, dedicated repair facility. In present art fume hoods, exhaust fans and environmental chambers, undesirable contaminants are confined and excluded at considerable cost to acquire and operate. Due to their inherent lack of mobility, these methods do not address the need to provide on-site service in a cost effective manner.

There is a need for a portable work station which can be set up at the location of the machine in need of servicing and which will permit the servicing of the toner cartridges in a controlled atmosphere which protects the components and prevents the escape of toner.

SUMMARY OF THE INVENTION

The purpose of this invention is to provide an environmentally contained portable work station. To accomplish this purpose, there is provided a two-piece carrying case, such as a suitcase, having means to remove and confine toner contaminants. Housed in the carrying case are items required for servicing electrophotographic equipment, namely hand tools, spectrum-specific illumination, a vacuum filter, electrical diagnostic equipment, trade-specific jigs for component handling, replacement toners, cleaning materials, and electrical outlets. In addition, the carrying case houses a unique canopy of collapsible material which can be erected when the case is opened. Collapsible stays are connected to the case to support the canopy with a front opening to provide access to the work areas being enclosed by the case and the canopy. The case's upper section contains a fan for pulling ambient air into the canopy front opening and exhausting the air out of the chamber after the air has been filtered to remove stray toner. The atmosphere surrounding the work station is thereby protected from toner contamination during the service operation, without the need to vent to the outside of the building. The interior of the work station is similarly protected from most pollutants from the surrounding area.

In one aspect of the invention there is provided a portable work station comprising:

a carrying case having upper and lower sections, said lower case section being adapted to rest in a generally horizontal position on a work surface, said upper case section being connected by hinges to said lower case section along their corresponding rear edges and being moveable between a closed position against said lower case section and an open position extending upright from said lower case section, said case sections having respective side and front edges which are in engagement when the upper case section is in a closed position with respect to said lower case section;

a canopy having peripheral edge regions secured respectively to side edges of said upper and lower case sections and to the front edge of said upper case section, said canopy having a front edge providing an opening to the interior of the canopy and to the interiors of said case sections; and means to remove and confine toner contaminants.

DESCRIPTION OF THE DRAWING

FIG. 1 is a perspective view of the carrying case for the work station;

FIG. 2 is a front elevational view of the work station as it appears with the carrying case opened and the canopy erected;

FIG. 5 is a horizontal sectional view taken generally as indicated by line 5—5 in FIG. 4;

FIG. 6 is a horizontal sectional taken generally as indicated by line 6—6 in FIG. 4; and FIG. 7 is an enlarged perspective view of a connector in the region encircled at 7 in FIG. 3.

DESCRIPTION OF THE PREFERRED EMBODIMENT

Figure 4:
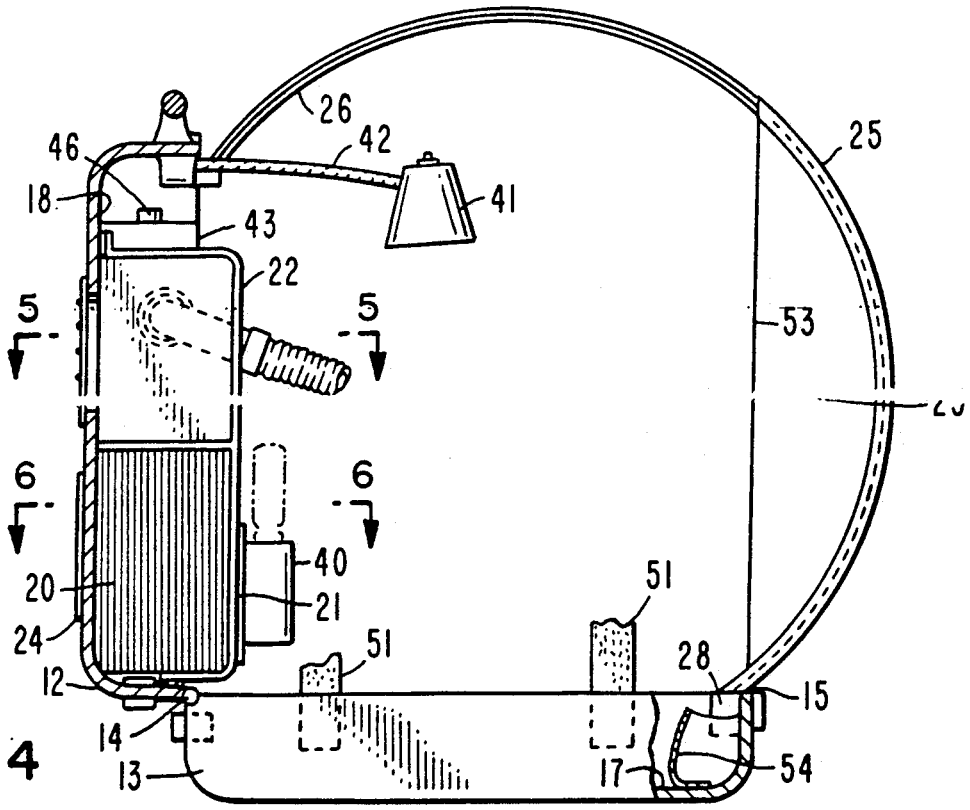
FIG. 4 is a vertical sectional view through the work station taken generally as indicated by line 4—4 in FIG. 3.

Referring specifically to FIG. 1, the carrying case shown generally at 11 for the portable work station of this invention is preferably a non-metallic suitcase having upper and lower case sections 12 and 13, respectively, which are connected at hinge connection 14 along their rear edges. (See FIG. 4.)

Figure 3:
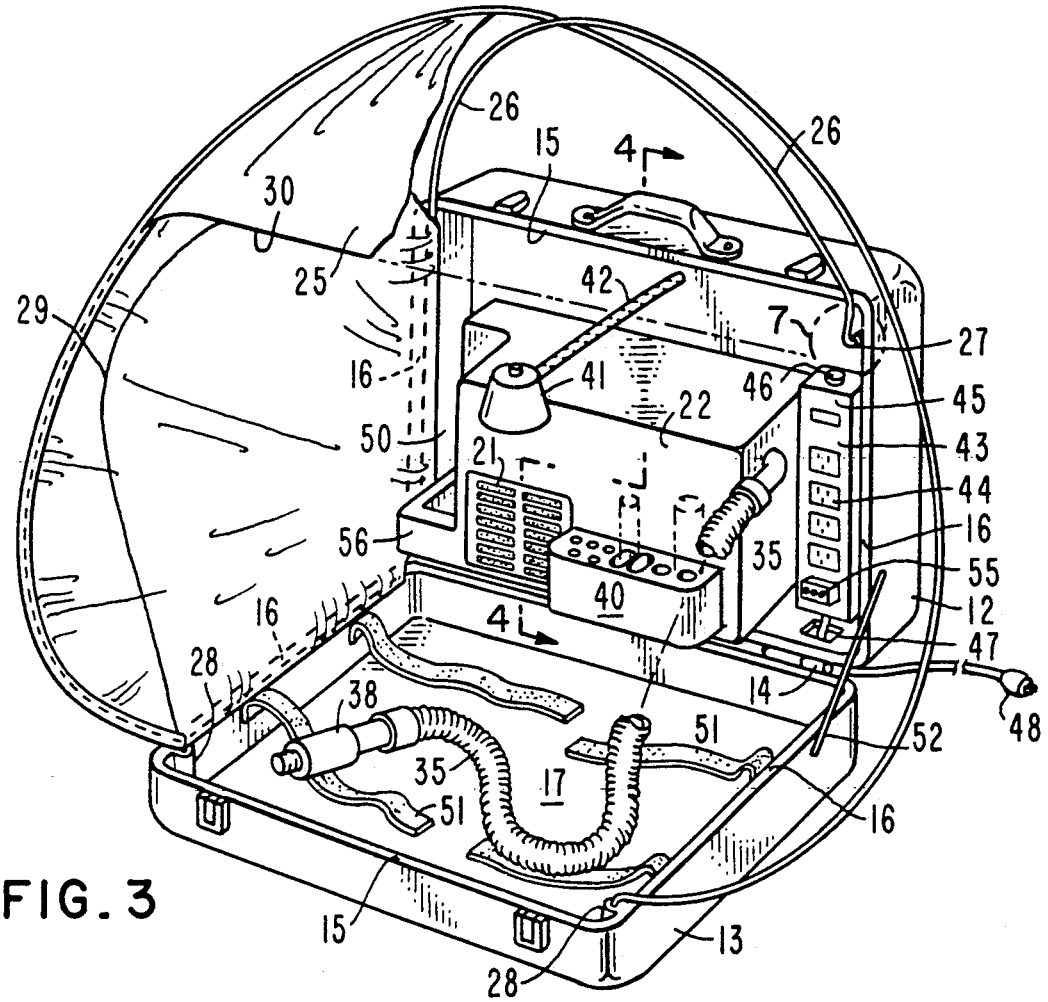
FIG. 3 is a three-quarter perspective view of the work station with portions of the canopy broken away to show the interior.

When the carrying case 11 is closed, the front and side edges 15 and 16, respectively, of the upper and lower case sections 12 and 13 are in engagement, as shown in FIG. 1. To open the carrying case 11, the lower case section 13 is laid flat on a work surface and the upper case section 12 is swung upwardly about hinge connection 14 to an upright condition (shown in FIGS. 3 and 4) where stays 52 constrain the two case sections in a stable, fixed position.

The inner work surface 17 of lower case section 13 is substantially unobstructed to provide a work surface. Inner work surface 17 is preferably lined with an impact-absorbing fabric which resists puncture or abrasion and which provides a non-skid environment. The lining material is preferably an inherently electrically conductive material which is electrically grounded to minimize the generation or build-up of electrostatic charges thereon. Any part of the work station so charged would undesirably attract airborne toner particles and would endanger electronic circuitry with possible excess electrostatic discharge.

The inner surface 18 of upper case section 12 constitutes an appliance support surface and is adapted to support an air exhaust system comprising a motor-driven exhaust blower, or fan 19 and a filter 20. The air exhaust system is part of the means to remove and confine toner contaminants. Fan 19 draws air past the operator positioned outside opening 29, over inner work surface 17 through an opening 21 in appliance cover 22, through filter 20, and exhausts the filtered air out an opening 23 in upper case section 12. If desired, opening 23 may be provided with a protective grill 24 to prevent foreign objects from interfering with the operation of fan 19. An external exhaust hose may be attached from opening 23 to conduct exhaust air away from the work station. Supplemental filtration techniques may be applied to exhaust air should work conducted inside or outside the work station so require.

The purpose of the air exhaust system comprising fan 19, filter 20, and appliance cover 22 is to prevent the escape of loose toner from the work station. Movement of air across inner work surface 17, the interior of canopy 25, and lower case section 13 carries any such loose toner into filter 20 where it is entrapped prior to the air's being exhausted. Filter 20 is preferably of a non-clogging variety presenting minimal resistance to air flow in order that fan 19 be quiet enough to be constantly active in a business office environment. Filter 20 preferably has the ability to entrap large volumes of toner and other debris before needing to be cleaned or replaced.

Air flow through opening 29 is confined within the work station by canopy 25 positioned above the work surface. It can be seen from the Figures that the canopy 25, appliance cover 22, and the lower case section 13 comprise a shape which serves as a hyperbolic guide to air flow, the approximate focal point of the hyperbola being the opening 21 in appliance cover 22. Canopy 25 has its rear edges secured just inside the front and side edges 15 and 16, respectively, of upper case section 12. The lower edges of canopy 25 are secured just inside the side edges 16 of lower case section 13. The edges of canopy 25 are preferably secured by means of a detachable mechanical connection (such as a Velcro TM type fastener) allowing canopy 25 to be entirely removed for cleaning or replacement. Inner work surface 17 is accessible to the operator of the work station through opening 29. Opening 29 can alternately be occluded with a panel 53 through which the hands or arms of the operator are extended while working within the work station.

Canopy 25 is preferably made of flexible fabric which is either electrically conductive or has been treated to be electrically conductive and is preferably electrically grounded so that static electricity charges are neither generated nor retained thereon. Canopy 25 serves not only to confine the air flow over inner work surface 17 and to contain any airborne contaminants, but also serves to keep out undesirable light which might adversely affect the copier or printer components being serviced in the work station.

Canopy 25 is collapsibly supported on the upper and lower case sections 12 and 13, respectively, of carrying case 11 by one or more stays 26. The connection of stays 26 to carrying case 11 is preferably by means of universal connectors 27 to provide rigidity when extended, yet allowing convenience in collapsing and storing stays 26 and canopy 25. Stays 26 may alternately be slidably received at one or both ends by a hollow socket assembly mounted upon upper and lower case sections 12 and 13, respectively.

Stays 26 are preferably made from spring-like metal or plastic material. When in place, stays 26 press forwardly and outwardly upon canopy 25, thus placing canopy 25 under tension and supporting it above inner work surface 17 and away from appliance cover 22.

Housed within appliance cover 22 on the appliance carrying inner surface 18 is vacuum cleaner 32 used to remove toner and other debris from components being serviced in the work station. Vacuum cleaner 32 is another part of the means to remove and confine toner contaminants. Vacuum cleaner 32 comprises a housing 34 in which a motor-driven blower 33 draws air through hose 35 into filter chamber 36, also situated within housing 34. Filter chamber 36 is preferably a rigid, disposable cartridge capable of trapping large volumes of fine particle debris before the filter needs to be replaced. Clean air from vacuum cleaner 32 is permitted to exit the work station through opening 37 in upper case section 12.

Hose 35 is preferably constructed of flexible material. Hose 35 and nozzle 38 at the distal end thereof are preferably made of conductive material and are electrically connected to the chassis ground to prevent the generation or the build-up of electrostatic charges. Electrical connection to the chassis ground is preferably in series with a one megohm solid state resistor which serves to reduce the risk of the operator's becoming endangered in the event that exposed domestic current contacts the operator while the operator is in contact with the electrically grounded work station.

Evidence of the presence or absence of sufficient electrical conductivity between the work station and the electrical ground of the building in which the work station is deployed is preferably indicated to the operator by means of circuit analyzer device 55 installed at power tap 43.

As a further convenience to the user of the work station, appliance cover 22 on the upper case section 12 may have one or more tool holders 40 affixed to the face thereof. Tool holder 40 is adapted to store tools, such as screw drivers, within easy reach of a person using the work station. Tool holder 40 is preferably attached with a mechanical joint (such as a Velcro TM type fastener) by which the holder may be exchanged for alternate types of tool holders specific to different tasks undertaken in the work station. Tool holder 40 preferably incorporates a sponge rubber-like interior which exerts sufficient normal force upon the shafts of tools when slidably received in the holder that tools are sufficiently constrained in their respective positions during normal transportation of the work station. Tool holder 40 is preferably constructed of a semi-rigid (LEXAN TM polycarbonate sheet) material which allows tool holder 40 to be severely deformed in the event of improper closing of the work station but nevertheless allows tool holder 40 to resume its proper shape upon deploying the work station.

Storage pouch 54 is preferably attached to the interior front section of inner work surface 17 for storage of miscellaneous tools or supplies. Pouch 54 is preferably closed at its upper end by a mechanical seal (Velcro TM) to preclude possible spillage of its contents during transportation of the work station.

Storage compartment 50 is preferably incorporated in appliance cover 22 to allow such items as photocopier drums to be temporarily stowed in an environment that protects the drum from physical contact with items being manipulated within the work station. Compartment 50 is preferably of a configuration such that light approaching compartment 50 from work lamp fixture 41 or from opening 29 is largely precluded from reaching objects placed within compartment 50.

Storage compartment 50 is preferably outfitted with a holder 56 in which photoreceptor drums can be slidably received in indentations for temporary storage. Holder 56 is preferably constructed of electrically conductive sponge rubber-like material which upon receiving a drum exerts sufficient normal force upon the sides of the drum to constrain it during the course of other work being conducted inside the work station.

A work lamp fixture 41 is mounted on upper case section 12, preferably by means of flexible gooseneck 42. Attachment of gooseneck 42 to upper case section 12 is preferably by means of a swivel device that allows for convenient storage of the lamp assembly. The light emitted from work lamp fixture 41 should preferably be of a character which is not harmful to copier or printer components. The light source employed in lamp fixture 41 is preferably of a character that emits sufficiently small amounts of heat so as to allow air flow underneath canopy 25 to proceed largely undisturbed by heat-induced air currents. The light source is preferably of a character that is durable enough to remain functional regardless of rough baggage handling during transportation of the work station.

This invention further contemplates the safe supply of electrical energy to power exhaust fan 19, vacuum cleaner 32, work lamp fixture 41, circuit analyzer device 55, and other portable power tools, such as a drill or soldering iron, which might be employed in the work station. To this end a power tap 43 is preferably mounted on the inner surface 18 of the upper case section 12. Power tap 43 includes a series of electrical receptacles 44 into which cords from the various electrical appliances can be plugged. (See FIGS. 5 and 6.) Flow of electrical energy through power tap 43 is preferably under control of a circuit breaker 45 having a reset button 46 preferably protruding from the top of power tap 43. An access opening 47 is provided in the upper case section 12 through which power cord 48 of power tap 43 can be led. Power cord 48 is preferably outfitted with means for convenient retraction and stowing of cord 48 for transportation of the work station. Power tap 43 incorporates a separate insulated, isolated ground wire that provides electrical continuity between the electrical ground of the building electrical system and the receptacles 44 of the work station. The exterior surface of power tap 43 is preferably electrically conductive and electrically continuous with the electrical ground for convenience in establishing electrical continuity with upper and lower case sections 12 and 13, respectively, and with the other electrically conductive surfaces of the work station.

Tie down straps 51 for securing loose articles, such as canisters of compressed air, are preferably installed in lower case section 13 for use during transportation of the work station.

An optional feature of the work station is a task-specific jig or holder positioned upon inner work surface 17 to optimally orient components with respect to lighting, air flow, and the convenience of the operator of the work station.

What is claimed is:

1. A portable work station comprising:

a carrying case having upper and lower sections, said lower case section being adapted to rest in a generally horizontal position on a work surface, said upper case section being connected by hinges to said lower case section along their corresponding rear edges and being moveable between a closed position against said lower case section and an open position extending upright from said lower case section, said case sections having respective side and front edges which are in engagement when the upper case section is in a closed position with respect to said lower case section;

a canopy having peripheral edge regions secured respectively to side edges of said upper and lower case sections and to the front edge of said upper case section, said canopy having a front edge providing an opening to the interior of the canopy and to the interiors of said case sections; and means to remove and confine toner contaminants.

2. A work station as in claim 1 further including storage space for said canopy when the upper case section is in its closed position.

3. A work station as in claim 1 wherein said lower case section has an interior surface constituting a work surface and said upper case section has an interior surface constituting an appliance support surface.

4. A work station as in claim 3 wherein the appliance support surface of said upper case section has a portion of the means to remove and confine toner contaminants in the form of an exhaust fan thereon for withdrawing air from beneath said canopy and an opening in said upper case section for exhausting the air from said fan.

5. A work station as in claim 4 wherein the means to remove and confine toner contaminants includes a filter for filtering the air moved by said exhaust fan.

6. A work station as in claim 3 wherein the appliance support surface of said upper case section includes another portion of the means to remove and confine contaminants in the form of a vacuum device, a flexible hose connected to said vacuum device and extending to the work surface in said lower case section, and an opening in said upper case section for the exhaust air from said vacuum device.

7. A work station as in claim 6 wherein said flexible hose is electrically conductive and grounded to preclude the generation or the build-up of static electricity thereon.

8. A work station as in claim 1 wherein the canopy includes at least one stay connected to said carrying case by a universal coupling.

9. A work station as in claim 4 further including a cover for said exhaust fan and said vacuum device mounted on the appliance support surface of said upper case section, said cover being provided with means for routing exhaust air from the fan exclusively through the filter chamber, and means for routing exhaust from said vacuum device exclusively out of the case.

10. A work station as in claim 3 wherein said interior surfaces are electrically conductive.

11. A work station as in claim 10 wherein said interior surfaces are electrically continuous with other interior surfaces.

12. A work station as in claim 10 wherein said interior surfaces are electrically grounded.

13. A work station as in claim 3 wherein the appliance support surface of the upper case section has a work lamp mounted thereon for illuminating the work surface with an appropriately benign type of light.

14. A work station as in claim 3 wherein the appliance support surface of the upper case section has a holder for receiving and protecting components being repaired in said work station.

15. A work station as in claim 7 wherein the hose is electrically grounded.

16. A work station as in claim 1 wherein the canopy is held in position by one or more stays.

17. A work station as in claim 1 wherein the canopy is electrically conductive.

18. A work station as in claim 1 wherein the canopy is electrically continuous with the interior surfaces of the work station.

19. A work station as in claim 1 wherein the canopy of claim 17 is electrically grounded.

20. A work station as in claim 16 wherein the stay is collapsible.

21. A work station as in claim 16 wherein the stay is attached to the case by means of universal couplings.

22. A work station as in claim 16 wherein means is provided for detaching the stay from the case.

23. A work station as in claim 1 wherein means is provided for convenient removal and reattachment of the canopy with respect to the case.

24. A work station as in claim 4 wherein the audible noise emitted from the fan is proportionately lower than noise levels generated by typical office equipment.

25. A work station as in claim 1 wherein the means to remove and confine toner contaminants includes an appliance cover having an opening therein, the appliance cover, the canopy, and the lower case section comprise a shape which serves as a hyperbolic guide to air flow, the approximate focal point of the hyperbola being the opening in the appliance cover.

* * * * *